US005109686A

United States Patent [19]

Toussant

[11] Patent Number: 5,109,686

[45] Date of Patent: May 5, 1992

[54] KEYHOLE GUIDE FOR LOCKS AND METHOD OF USING THE SAME

[76] Inventor: Eugene Toussant, 7407 Oakhill Ave., Maximo, Ohio 44650

[21] Appl. No.: 577,504

[22] Filed: Sep. 4, 1990

[51] Int. Cl.[5] ..... E05B 15/08

[52] U.S. Cl. ..... 70/454

[58] Field of Search ..... 70/454, 455

[56] References Cited

U.S. PATENT DOCUMENTS

| | | | |
|---|---|---|---|
| 588,747 | 8/1897 | Haughton | 70/455 X |
| 1,789,756 | 1/1931 | Jacobi | 70/455 X |
| 2,617,290 | 11/1952 | Schwartz | 70/455 X |
| 4,023,388 | 5/1977 | Morvai | 70/455 |

*Primary Examiner*—Richard E. Moore
*Attorney, Agent, or Firm*—Oldham, Oldham & Wilson Co.

[57] ABSTRACT

A key-operated lock as is used in automobile doors and home doors, which device preferably comprising a base with a slot shaped cover secured aboout the lock. This base having a hinged cover and characterized by a slot shaped opening which fits about the lock. A plastic material within the cover and base is placed in a sealing relationship with the face of the lock and across the lock key entrance when the cover is in a closed position. The grooved base of the cover permits the opening or closing of the cover for use of the lock.

14 Claims, 3 Drawing Sheets

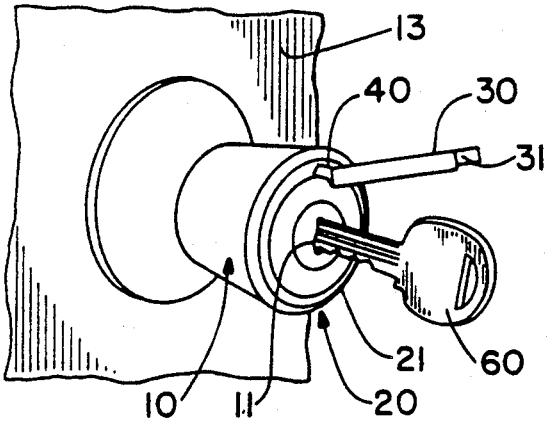
FIG.-1
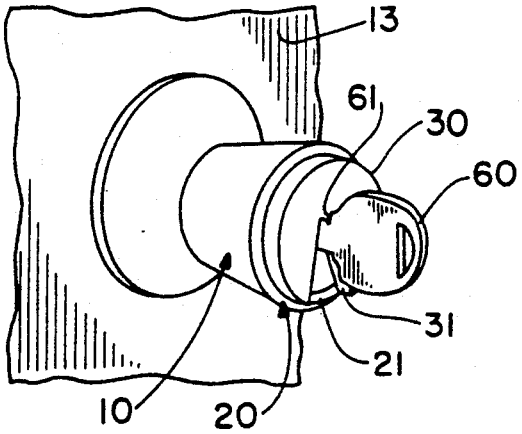
FIG.-1A
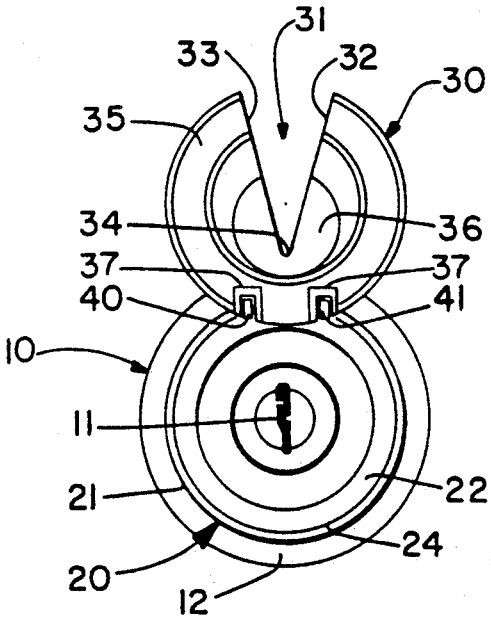
FIG.-2
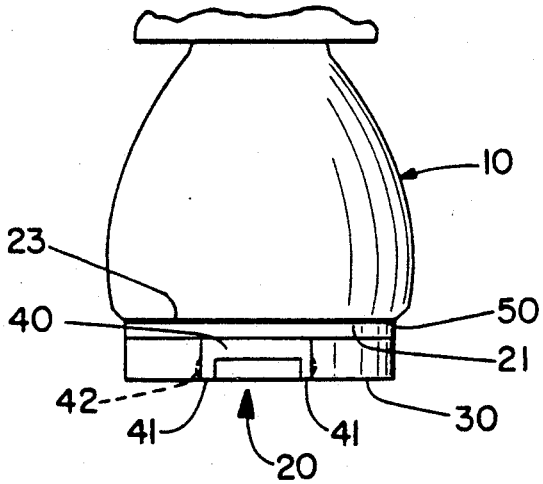
FIG.-3
FIG.-4
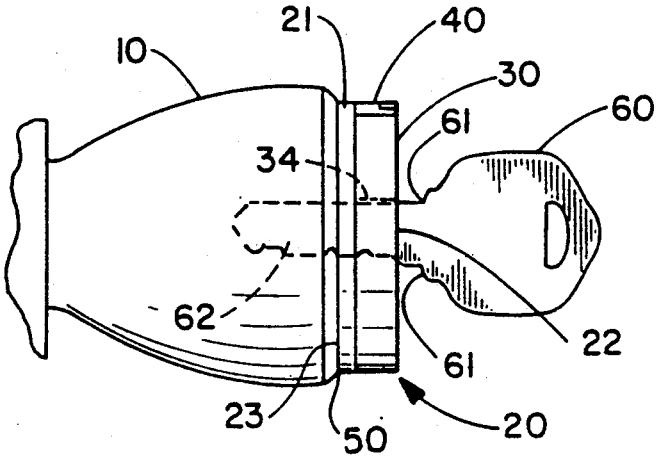

KEYHOLE GUIDE FOR LOCKS AND METHOD OF USING THE SAME

TECHNICAL FIELD

This invention relates to a key-operated lock as is commonly used in residential doors and automobile doors.

The invention is essentially a disc shaped cover with a wedge shaped slot formed therein. This slot is positioned so as to guide a key held by the user into the keyhole.

BACKGROUND OF THE INVENTION

This invention pertains primarily to locating the keyhole of a lock in a residential door or automobile door specifically during the nighttime hours.

The problem of locating the keyhole of the lock is quite old and a number of attempts have been made to assist persons with this task.

U.S. Pat. No. 2,993,362 to Baccolla in FIGS. 6 & 7 discloses a "V" configuration which guides a key to the keyhole but is permanently affixed to the door. It discloses two wing elements which separate and pivot outwardly.

U.S. Pat. No. 2,941,392 to Byrne discloses a inverted "V" shaped design which guides the key to the keyhole but can be distinguished from this invention because of its incapability of being pivoted away from the lock.

U.S. Pat. Nos. 4,858,454 to McAnulty and 4,825,673 to Drake disclose keyhole cover devices which offer protection from the natural elements but do not assist in locating the keyhole.

Therefore, in light of the deficiencies in the prior art the present invention is herein presented.

SUMMARY OF THE INVENTION

The keyhole guide of the present invention consists of a ring-like structure having a diameter greater than the height of the keyhole. This ring-like structure is adhesively mounted to the face of the door knob or door structure so as to circumferentially surround the keyhole. A disc-like cover is hingedly mounted to the ring structure and has approximately the same outer diameter so that in a closed position the cover engages a substantial portion of the ring and frictionally engages the same.

This cover contains essentially a wedge shaped slot with one open end. This open end is an arc on the outer circumference of the cover.

The keyhole guide of the present invention provides an aid for locating the keyhole of a lock especially in the dark, which once the keyhole has been located can be directed outwardly and away from the keyhole to more fully reveal the keyhole without removing the partially inserted key.

The main object of the invention is to provide a guide for a key which will assist a person to find the keyhole and insert the key in darkness.

It is a further object of the present invention to provide a keyhole guide which will assist elderly people and others with unsteady hands.

It is a further object of this invention to provide a keyhole guide which offers partial protection for the keyhole from the natural elements, such rain, sleet, snow etc.

It is yet another object of this invention to provide a keyhole guide which may be supplied at the time of purchase of a door or automobile that can be easily adaptable to a door lock.

It is yet another object of the invention to provide a keyhole guide for locks which when fastened can be secured, but semi-permanently fastened to the door lock until removal is desired.

It is still another object of this invention to provide a key hole guide which still allows full access to the key hole.

It is still another object of this invention to provide a keyhole locator which is inexpensive to manufacture and economical to purchase.

Other objects of the invention are to provide a keyhole guide which is easily adaptable for mass production, easy to install on the door over the face of the lock, of pleasing appearance, and which is durable, effective and efficient in use.

These and other objects and advantages of the present invention will become more readily apparent from the more detailed description of the preferred embodiment take in conjunction with the drawings. Such objects and advantages are achieved by a keyhole guide for locks having a keyhole comprising:

an annular ring structure having an open center, said open center having a diameter greater than the height of a keyhole, a cover having an outer diameter substantially equal to the outer diameter of said ring, said cover having slot cut there-in, a means for attaching said disc shaped cover to said ring structure, an adhesive means for adhesively attaching said ring structure to said door so as to circumferentially surround a substantial portion of the keyhole of said door knob.

BRIEF DESCRIPTION OF DRAWINGS

FIG. 1 is a perspective view of a cut-away section of a door illustrating a conventional household doorknob and the present invention as installed thereon.

FIG. 2 is a front elevational view of the keyhole locator.

FIG. 3 is a top plan view of the present invention as installed on a door knob.

FIG. 4 is a side elevational view of the present invention closed over the lock with the partially key inserted.

DETAILED DESCRIPTION

Figure 5:
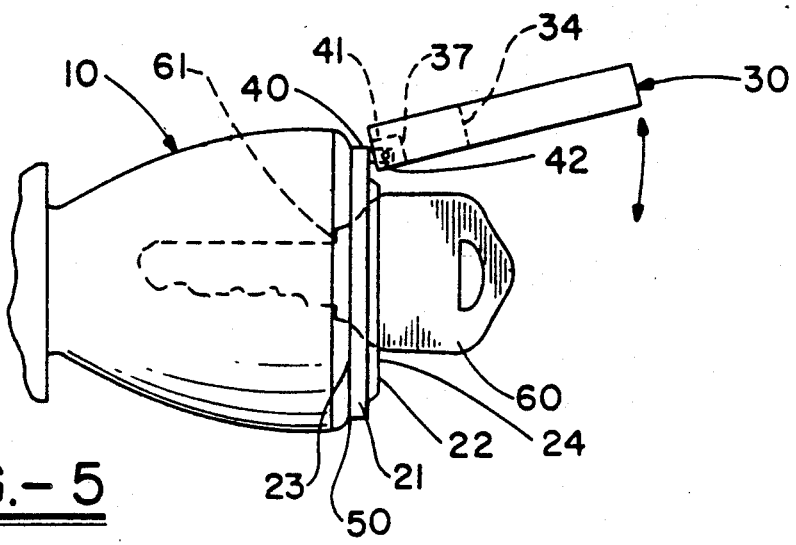
FIG. 5 is a side elevational view of the present invention in the open position with the key fully inserted.

Referring now to the figures, and looking specifically at FIG. 1, FIG. 1 introduces a perspective view of a standard door knob 10. The present device 20 is in an open position and comprising generally a ring-like base 21, disc shaped cover 30 and a hinge 41. The present invention discloses a ring-like base 21 which is attached to a cover 30 by a hinge 41. The cover 30 is essentially disc-shaped and has a wedge shaped slot 3 cut therein. The material that is preferred for making the device 20 is a durable plastic. However, other materials which would not rust or deteriorate during prolonged exposure to the outdoors are contemplated. The major components of this device are preferably formed using injection molding techniques.

Now looking at FIG. 1A, this figure illustrates the cover 30 in a closed position guiding the key to the lock.

FIG. 2 is a front elevational view of the device fully opened. The ring-like base 21 of the present invention is mounted to circumscribe the keyhole 11. The ring-like base 21 is attached to the cover 30 of the invention by a hinge member 40 with two extensions 41 and projections 42 on the outside of the extensions. These projections 42 snap into slots 37 formed in the cover 30. Slots 31 in cover 30 is formed by surfaces 32 and 33 which meet at reference point 34. Cover 30 is to be positioned so that reference point 34 of the slot 31 is located at the top of keyhole 11. The slot in this particular case is an inverted "V" which is the preferred shape but the invention does not preclude other shapes from being used for the slot 31 in the cover. The inverted "V" shape in this manner serves to provide some protection to the key hole 11 from the weather elements.

The orientation on the "V" in the cover depends on which way keyhole is oriented (meaning the way a cylinder is installed). A cylinder is a solid metal chamber which houses the keyhole. When key is inserted in this keyhole 11 of the cylinder, the lock turns to either unlock or lock a door. If the flat part of the key is up, the "V" should be inverted, and if the flat part of the key is down, the "V" should be situated as a "V". The preferred shape of the "V" is the inverted "V" shape because of the protection provided by this shape against the weather elements. Also the shape of the cover 30 and the shape of the base 21 of the present invention are not required to have disc shaped or ring shaped structures. The cover on the door lock could have a more convex shape or dome shape. This would make the device less noticeable on a car embodiment, and more decorative, and also would prevent these devices from being caught on objects such as car wash bristles and the like.

Also, the cover on the door lock could have a hexagon or octagon shape that would correspond to a hexagon or octagon shape on the base of the present invention for a more decorative feature. These shapes must substantially surround the keyhole.

The cover 30 of the present invention has a groove 35 on its underside and the groove 35 fits on a step formed on the outer surface 20 of the ring-like base as to snappingly engage on the ring-like base 21 thereon with a friction fit. The surface of the door knob is denoted by number 12. An inner solid surface core 36 is attached to the inner most surface of the cover 30. This inner solid surface core 36 is of the same angle as cover slot 31. The function of this inner solid surface core 36 is to guide keyhole at final stage and to prevent lateral movement of key.

FIG. 3 is the top plan view of the present invention as installed on a standard door knob. The back surface 23 of the ring-like base 21 of the present invention is covered with an adhesive layer 50 which is then affixed to the surface 12 of the door-knob 10. This adhesive layer 50 must be strong enough to hold ring structure on door when cover is lifted and hold for repeated uses. Also this adhesive layer 50 must be resistent to the elements of nature such as rain, snow and extreme temperature changes, etc. The present invention can be sold with a liner that covers the adhesive layer until it is ready to be exposed to the door lock. Cover 30 has slots 37 to receive the extensions 41 of the hinge member 40. Slot 37 contains depressions which correspond to projections 42 to enable cover 30 to rotatably pivot around projection 42. The hinge 40 does not have to be at the top of the ring-like base 21 of the invention. it could be a pivotal hinge at the sides or at the bottom of ring-like base 21, but the preferred location is the top of the ring-like base 21.

FIG. 4 is a side elevational view of the door knob 10 illustrating the present invention as installed on door 13 as the user would find when encountering the lock in a closed position. The shaft 62 of key 60 is inserted into the opening 31 of the cover 30 and the key 60 is moved upward towards the keyhole 11. The sides 32, 33 converge to a point 34, "funneling" key 60 into the keyhole 11. The shaft 62 of the key 60 is to be inserted as far as possible until shelf 61 of the key 60 comes to rest against the outer surface of cover 30. The shelf 61 of the key 60 rests against the outer surface 22 of the ring-like base 21 of the present invention. This ring-like base 21 also has a lip or ridge denoted by the numeral 24 which helps engage the cover 30 for a friction fit.

FIG. 5 illustrates a similar view to FIG. 4 with cover 30 in an open position. This side elevational view illustrates how the cover 30 when open allows the full insertions of key 60. There is preferably a workable ratio between the length of slot opening 31 and the height of keyhole 11. The ratio should be somewhere between $1\frac{1}{2}$–4, the slot being substantially larger than keyhole 11. However, the preferred ratio is $1\frac{1}{2}$–$2\frac{1}{2}$.

The hinge member 40, extensions 41 and projections 42 allow the cover to flip out and away to allow access to the lock by the key 60. Also, the hinge member could be a spring biased hinge which allows the cover 30 to close back over the keyhole 11.

Figure 6:
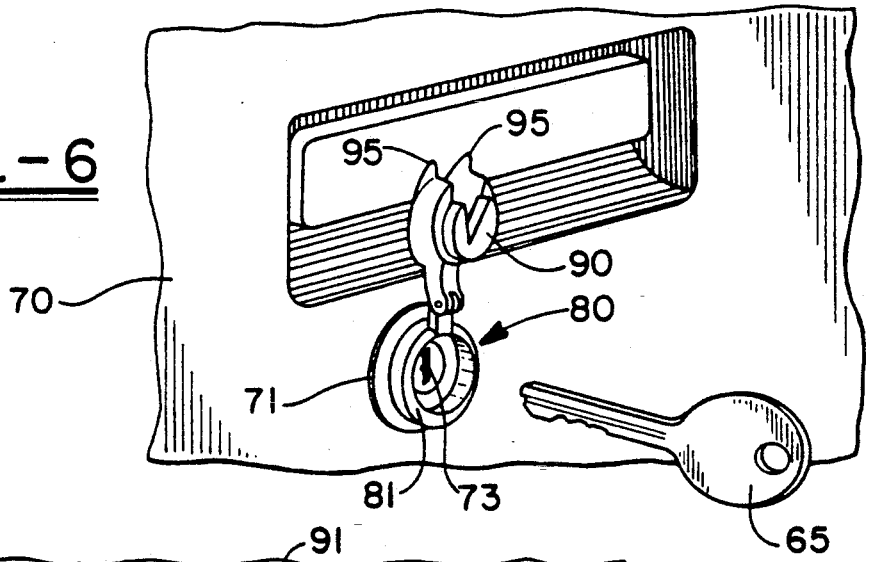
FIG. 6 is a perspective view of the cut-away section of a vehicle door showing the handle and lock with invention installed thereon.

FIG. 6 illustrates an alternative embodiment of a motor vehicle door 70 wherein a keyhole guide of the present invention is installed. FIG. 6 illustrates a car door 70 where the keyhole guide for the locks will be placed. The keyhole guide will be placed over the door lock 71 of the motor vehicle. The door lock 71 has a keyhole which is denoted by number 73. The key 65 fits into this keyhole 73. The keyhole device which is denoted generally by number 80 is attached to the ring 81 of the device. This device 80 has a disc-shaped cover 90.

Figure 7:
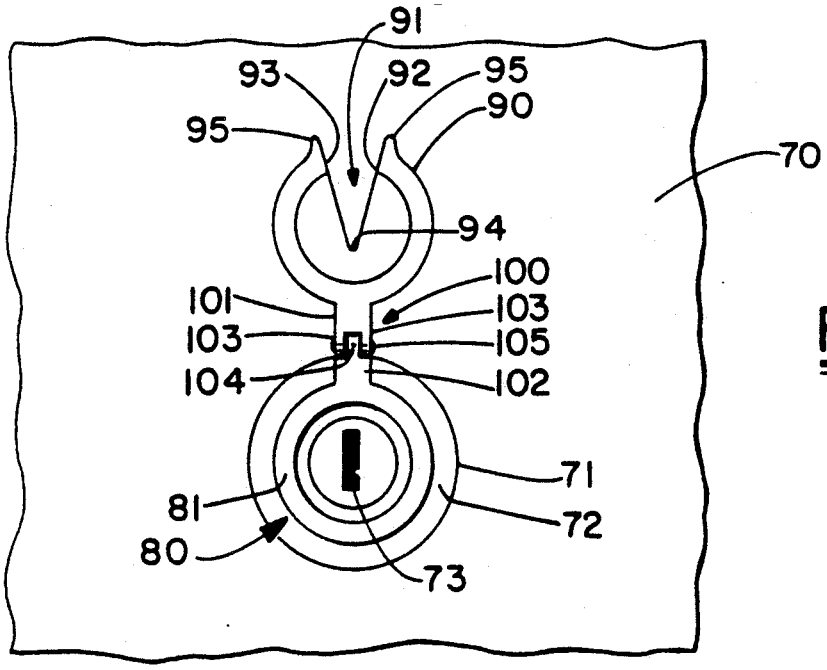
FIG. 7 is a front elevational view with device in open position.

FIG. 7 is a front elevational view of the device fully open. The disc shaped cover 90 of the device 80 has a slot 91 which is formed in cover 90 by surfaces 92 and 93 which join at a reference point 94 giving the cover its slot shape 91. The hinge 100 is generally composed of a hinge member 101, having projections 103 which define a notch dimensioned to receive projection 104 of the hinge base 102 and retained in such relationship by a pin 105. This hinge 100 gives the cover 90 the ability to open or close on the ring-like base 81 of the device 80.

Figure 8:
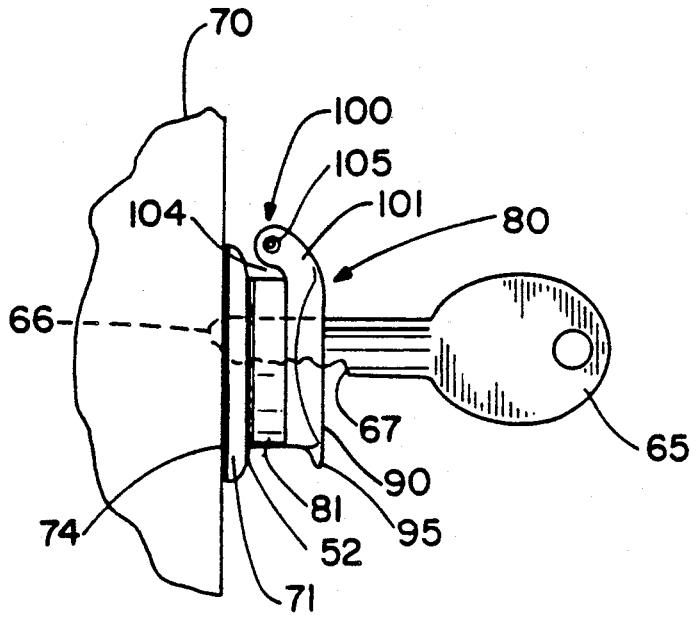
FIG. 8 is a side elevational view with device in closed position and the key partially inserted.

FIG. 8 is a side elevational view of the door lock. The key 65 is partially inserted in the lock. The adhesive layer 52 is attached to the top surface of the door lock 71 and the ring surface 81 of the door 70 where the keyhole device 80 is then placed over the door lock 71. The door lock 71 has a gasket 74 between door and lock to prevent introduction of moisture. The hinge 100 and its parts 101, 102, 103, 104 and 105 give the cover 90 of the keyhole device 80 the ability to open and close. Also, instead of using adhesive to attach the present invention to the door of the motor vehicle door, other means such as a magnet can be used in the place of the adhesive layer.

Figure 9:
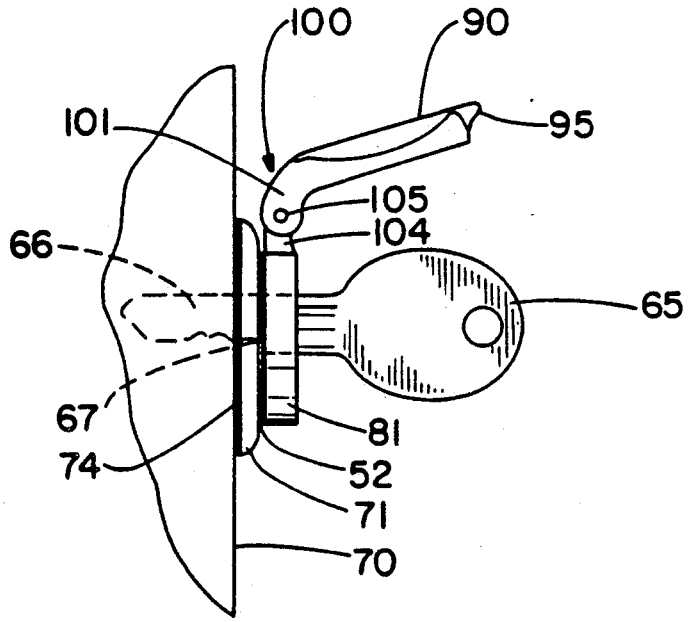
FIG. 9 is a side elevational view with device in open position and the key fully inserted.

FIG. 9 is the same view as FIG. 8 only open. FIG. 9 is a side elevational view with device in open position with key fully inserted. This figure also illustrates finger grips 95 placed at the ends of surfaces 92 and 93 which make it easier to open or close the cover.

While in accordance with the patent statutes the best mode and preferred embodiment of the invention have been described, it is to be understood that the invention is not limited thereto, but rather is to be measured by the scope and spirit of the appended claims.

What is claimed is:

1. A keyhole guide for mounting onto a key receiving member over a keyhole in said member comprising:

a base member having an essentially ring like structure having an open center, said open center in registry with said keyhole and having a diameter sufficient to fully expose said keyhole, a cover having an outer diameter at least equal to the diameter of said open center of said base member, said cover removably attached to said base member and having a slot cut therein, said slot having at least two sides converging to an apex and fully exposing said keyhole in said slot;

a means for attaching said base member to a key receiving member so as to circumferentially surround a substantial portion of the keyhole of said key receiving member.

2. A keyhole guide according to claim 1 wherein said cover is essentially disc shaped.

3. A keyhole guide according to claim 1 wherein said cover is hingedly connected to said base member and pivotal about said hinge between a guiding position in which said cover engages said base member and an exposing position in which said cover is cleared away from said base member.

4. A keyhole guide according to claim 1 wherein said cover has an essentially convex shape.

5. A keyhole guide according to claim 4 wherein said cover is essentially dome shaped.

6. A keyhole guide according to claim 1 wherein said slot has an open "V" shape.

7. A keyhole guide according to claim 6 wherein said slot shape has an open inverted "V" shape.

8. A keyhole guide according to claim 3 a spring means biased so as to urge said cover into attachment with said ring.

9. A keyhole guide according to claim 1 wherein slot in said cover is positioned so as to funnel a key into operative contact with said keyhole.

10. A keyhole guide according to claim 1 wherein said means of attaching is an adhesive means.

11. A keyhole guide according to claim 1 wherein said adhesive further comprises a removable release liner covering said adhesive until use of adhesive.

12. A keyhole guide according to claim 1 wherein said guide is attachable over the keyhole in a doorknob.

13. A keyhole guide according to claim 1 wherein said guide is attachable over a vehicle door lock.

14. A method of guiding a key into a keyhole of a lock comprising the steps of:

a) inserting a key into a slot in a keyhole guide, said keyhole guide comprising a base member having an essentially ring like structure having an open center, said open center in registry with said keyhole and having a diameter sufficient to fully expose said keyhole; a cover having an outer diameter at least equal to the diameter of said open center of said base member, said cover removably attached to said base member and having a slot cut therein and said slot having at least two sides converging to an apex and fully exposing said keyhole in said slot; and a means for attaching said base member to a surface so as to circumferentially surround a substantial portion of the keyhole;

b) directing said key towards the apex of said slot;

c) inserting said key into the keyhole; moving said cover of said keyhole guide to an exposing position in which said cover is cleared away from said base member, thereby exposing the open center of said base member.

* * * * *